US005884342A

United States Patent [19]

Maake

[11] Patent Number: 5,884,342

[45] Date of Patent: Mar. 23, 1999

[54] TOILET SEAT AND LID HINGE

[76] Inventor: Roger W. Maake, 15027 Walters Rd., Houston, Tex. 77068

[21] Appl. No.: 897,261

[22] Filed: Jul. 18, 1997

Related U.S. Application Data

[60] Provisional application No. 60/022,145 Jul. 18, 1996.

[51] Int. Cl.[6] ..... A47K 13/12; A47K 13/10

[52] U.S. Cl. ..... 004/236; 004/246.1

[58] Field of Search ..... 4/236, 240, 246.1

[56] References Cited

U.S. PATENT DOCUMENTS

| | | |
|---|---|---|
| 1,031,876 | 7/1912 | Schossow . |
| 1,821,027 | 9/1931 | Oya . |
| 2,214,323 | 9/1940 | Carter . |
| 2,849,728 | 9/1958 | Gyllenberg . |
| 3,404,411 | 10/1968 | Newkirk . |
| 3,516,095 | 6/1970 | Clifton et al. . |
| 3,528,075 | 9/1970 | Leon . |
| 3,780,384 | 12/1973 | NA . |
| 3,781,924 | 1/1974 | Davis, Jr. . |
| 4,291,422 | 9/1981 | Shoemaker et al. . |
| 4,551,866 | 11/1985 | Hibbs . |
| 4,777,671 | 10/1988 | Kearns . |
| 4,912,783 | 4/1990 | Shafer . |
| 4,917,757 | 4/1990 | Johnson . |
| 4,984,666 | 1/1991 | Orii et al. . |
| 5,101,518 | 4/1992 | Phillips . |
| 5,193,230 | 3/1993 | Guerty . |
| 5,222,260 | 6/1993 | Piper . |
| 5,267,356 | 12/1993 | Gideon et al. . |
| 5,289,593 | 3/1994 | Lawrence . |
| 5,307,524 | 5/1994 | Veal . |
| 5,343,571 | 9/1994 | Guerty . |
| 5,369,814 | 12/1994 | Denys . |
| 5,400,442 | 3/1995 | Pendlebury . |

*Primary Examiner*—Charles E. Phillips
*Attorney, Agent, or Firm*—Harness, Dickey & Pierce, P.L.C

[57] ABSTRACT

A toilet hinge apparatus that automatically initiates a regulated closing of the toilet lid and seat when the toilet is flushed providing a safety barrier for child and pet protection as well as for sanitary and aesthetic reasons. A pressure tee attached to the ballcock or tank valve thread at the water supply inlet to the toilet tank designed to amplify the difference between a low pressure when the toilet is flushed and the tank is filling and a high pressure when the tank is full and the tank valve is closed. An internal expanding brake mechanism that creates friction between the rotating parts of the hinge assembly relative to this pressure making the toilet seat and lid rotate easier at low tee pressure than at high tee pressure. A pair of independent torsion springs that force an open toilet lid and seat to close when the toilet is flushed and frictional braking is released with one spring providing torque to the toilet seat, counterbalancing it so that it will descent but not strike the china bowl unless assisted by the descending toilet lid and with the other spring partially counterbalancing the weight of the toilet lid. An internal displacement of a viscous dampening fluid to retard the opening and closing of the toilet lid. A check ball designed to seal the pressure tube and provide high pressure protection of the hinge assembly and prevent water leakage in the advent of a leak in the hinge assembly. An isolation bladder that prevents contamination of the water supply by the non-freezing fluid in the hinge assembly cavity that transfers the pressure to the expanding frictional brake surfaces that is volumetrically adjustable to establish the checking pressure for the check ball.

20 Claims, 4 Drawing Sheets

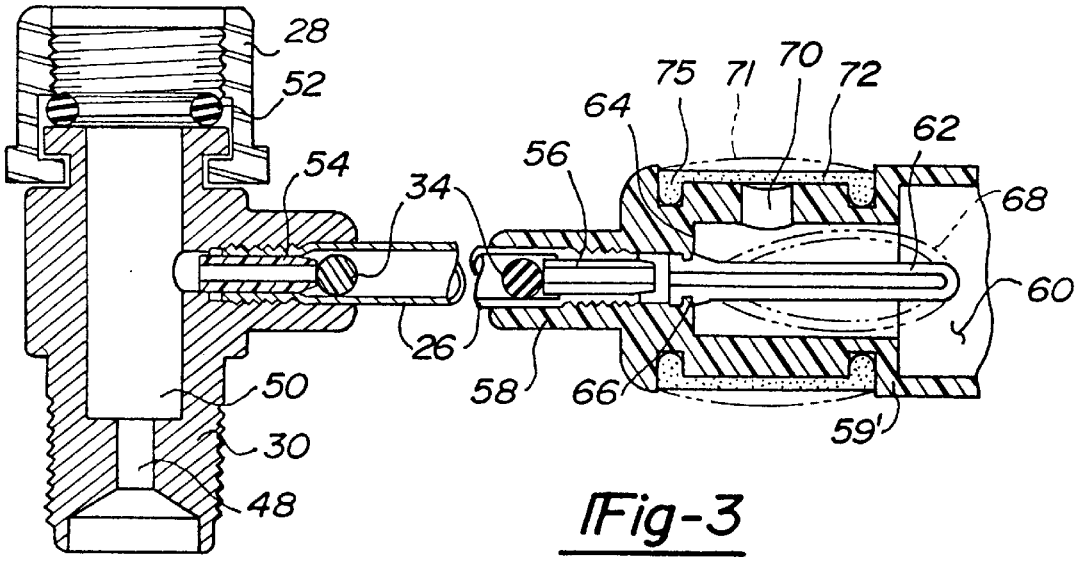
Fig-3
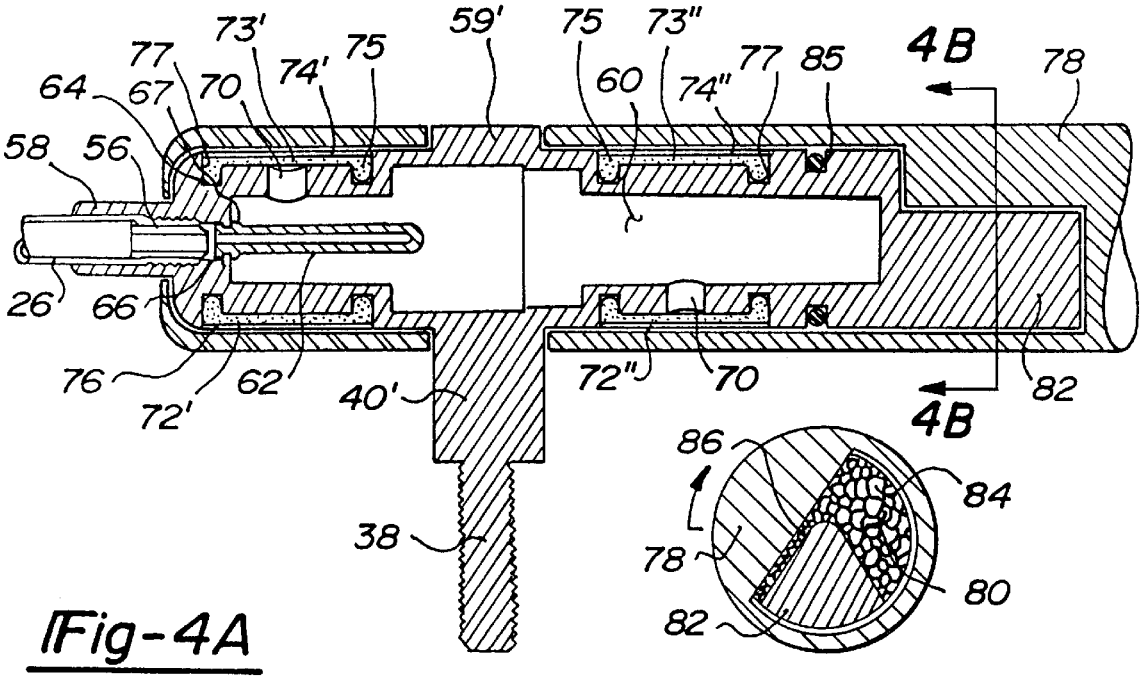
Fig-4A
Fig-4B

TOILET SEAT AND LID HINGE

CROSS REFERENCE TO RELATED APPLICATION

This application claims the benefit of Provisional Application Serial No. 60/022,145, filed Jul. 18, 1996.

BACKGROUND OF THE INVENTION

This invention relates to the automatic closing and regulation of motion of the toilet lid and seat. More particularly, the present invention relates to a hinge for a toilet seat and lid, the hinge being able to regulate the opening and automatic closing of the toilet lid and seat.

It is well known that containers of all varieties with standing water are an attractive nuisance for small children. Recently, there have been much publicized incidents where small children have downed or been injured in the water contained in a five gallon bucket. These incidents have even led to the placing of warning labels on the buckets. Less publicized are the incidents where children have drowned or been injured in connection with a toilet. While functionally different for their intended purpose, both buckets and toilets operate by containing a standing volume of water. The present invention, however, pertains only to the latter.

Devices which raise and lower toilet seats and lids for sanitary, child safety and other reasons are well known in the art. Prior art designs, however, all have various limitations, mostly in that they are cumbersome and require dangling or protruding apparatuses which are bonded or affixed in various manners to the toilet assembly or surrounding areas. As a result, these designs do not adequately address the safety and sanitary issues associated with the toilet.

Accordingly, there exist a need for a safe and sanitary device to automatically accomplish the task of returning the toilet lid and seat to the closed position when the toilet is flushed. As a related concern, it is desirable that the device attempt to prevent young children from coming into contact with the toxic, unsanitary and dangerous conditions which may be present in an open toilet. Pet protection from these conditions is also an issue.

It is the object of the present invention to provide a new hinge mechanism employing mechanical, hydraulic and pneumatic principals which can be retro-fitted to existing toilets and which will be compatible with existing seat and lid arrangements so as to provide for a safer, more sanitary and cosmetic operation of the toilet seat and associated lid.

SUMMARY OF THE INVENTION

In the disclosed embodiment of the present invention, a hinge mechanism provides for the automatic closing of the toilet lid and seat after the toilet is flushed. The hinge is coupled to the water supply line going into the toilet tank and operates off of the change in water pressure which occurs therein when the toilet is flushed. In this manner, the hinge offers aesthetic appeal by closing the toilet seat and/or lid after each use. Further, the invention helps to protect and deter young children and pets from exploring, playing, drinking or falling into a toilet bowl which may contain unsanitary or toxic waste products as well as detergents, disinfectants and the like.

Another aspect of this invention is that it provides for a regulated return of the toilet lid and seat to the closed position after the toilet is flushed. This regulated return of the seat and lid facilitates a soft "landing" of the lid and seat into the closed position thereby preventing the banging associated with a dropped lid or seat.

Another feature of this invention is the addition of resistance to lifting of the toilet lid into its open position. This increased required opening force of the lid further facilitate the child protection aspects of the present invention.

Still another aspect of this invention is that it provides the ability to manually override hinge system so that the toilet seat or lid may be closed without having to flush the toilet.

BRIEF DESCRIPTION OF THE DRAWINGS

FIG. 3 is a cross-sectional view with portions broken away of part of a hinge assembly embodying the principles of the present invention;

FIG. 4A is a longitudinal sectional view similar to that of FIG. 3 further showing the pressure bladders, friction generating bladders and dampening features of the present invention;

FIG. 4B is a sectional view taken generally along line 4B—4B in FIG. 4A of the dampening feature of the present invention;

DETAILED DESCRIPTION OF THE INVENTION

The following discussion of the preferred embodiment of the invention concerns a hinge which operates as an automatic closure and provides resistance to the opening of a toilet lid and seat. This discussion is merely intended to be exemplary in nature and not intended to limit the invention, its application to other devices, articles or uses in any way.

Figure 2:
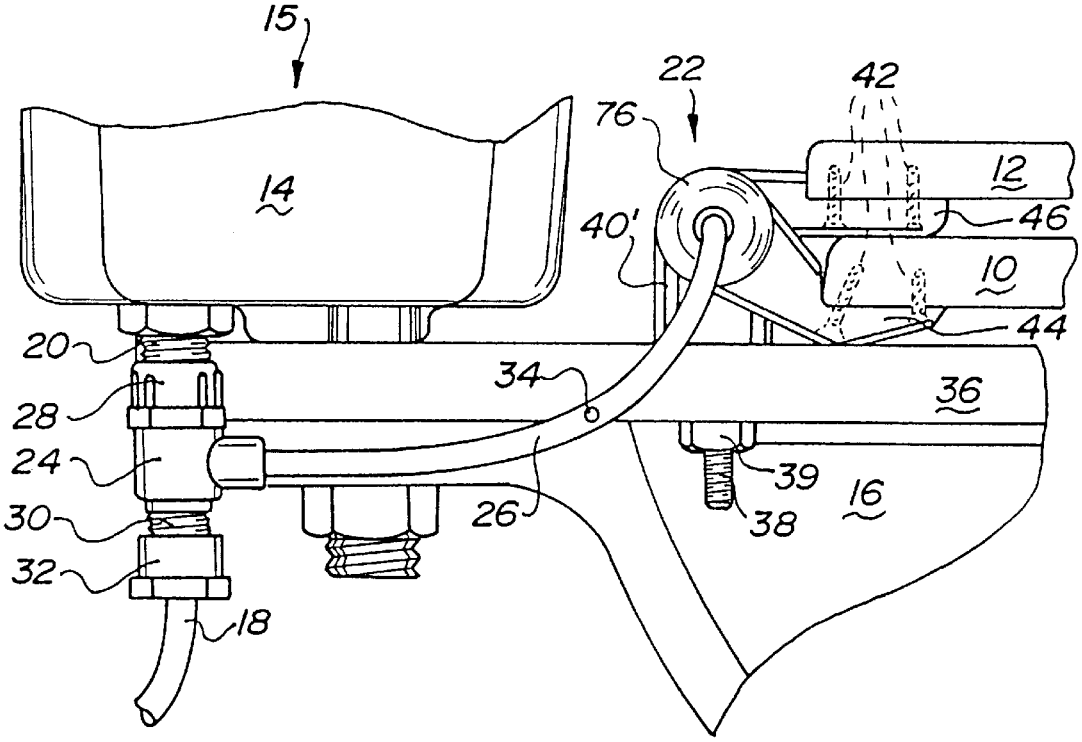
FIG. 2 is a partial side elevational view of a hinge assembly embodying the principles of the present invention after being installed on a conventional toilet and showing a toilet seat and lid in their lowered positions.

Referring to FIG. 2, a water closet or toilet 15 is shown as having a tank 14 and bowl 16 located in a conventional construction and position with a water supply line 18 attached to the tank 14 at a threaded ballcock fitting 20 on a lower side wall of the tank 14. Also, illustrated are a seat 10 and lid 12. The operation and structural aspects of the toilet 15 are conventional in nature and thus, these aspects are not and need not be elaborated herein.

Figure 1:
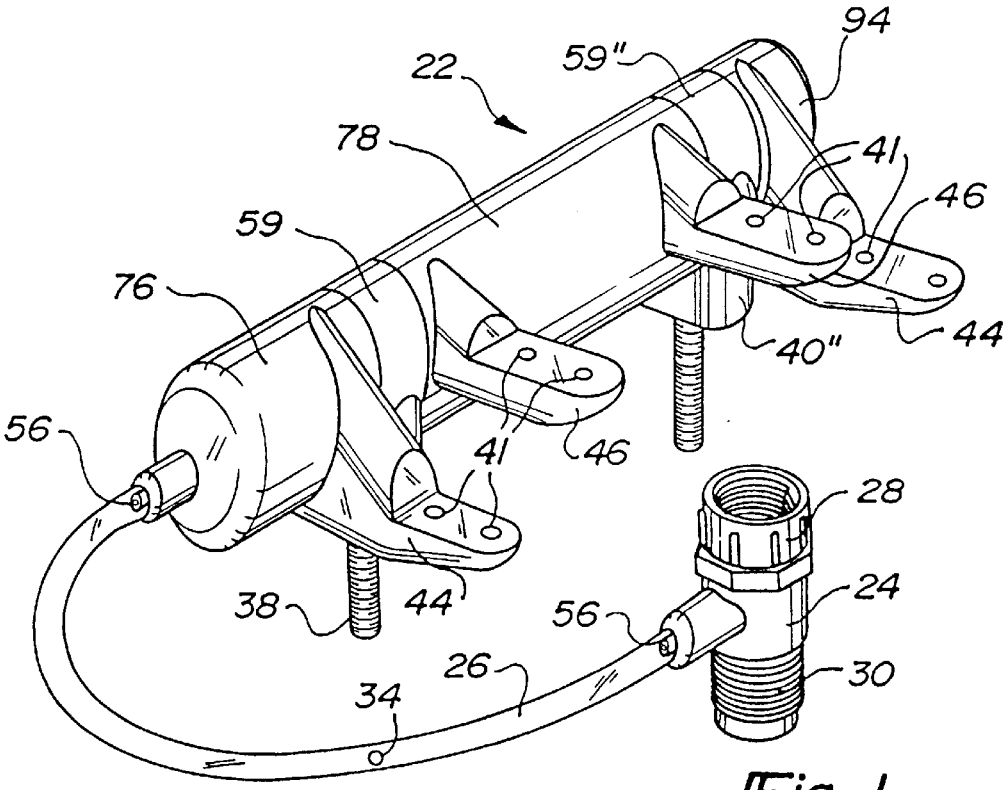
FIG. 1 is a perspective view of a hinge assembly embodying the principles of the present invention.

A hinge assembly according to the present invention is seen mounted to the bowl 16 in FIG. 2 and is shown alone in FIG. 1. The hinge assembly is generally designated at 22 and is hereinafter just referred to as "hinge 22". As seen in FIG. 2, the hinge 22 includes and is connected by a pressure tee 24 and a tube 26 to the water supply line 18 at the ballcock fitting 20. A threaded nut 28 formed on the pressure tee 24 mounts to the ballcock fitting 20 of the tank 14 while a threaded end 30 receives a threaded nut 32 of the water supply line 18. The body of the pressure tee 24 is capable of being rotated relative to its nut 28 and the ballcock fitting 20 for proper positioning of the tee 24.

According to a preferred embodiment of the present invention, the body of the pressure tee 24 has defined therethrough a "T" shaped passageway which allows water from the supply line 18 to at least partially fill the pressure tube 26 and compress air contained therein according to the amount of water pressure within the supply line 18 and the tube 26. To compress the air, a check ball or element 34, preferably having a specific gravity less than water and floating to the head of the water in the pressure tube 26, is provided. This is discussed in further detail below.

The hinge assembly is attached to the rim 36 of the toilet bowl 16 in a known and acceptable manner, such as through ⅜-16 NC mounting studs 38 which are attached to mounting left and right stanchions 40' and 40". The hinge 22 is also secured to the toilet lid 12 and seat 10 through a known and accepted manner, such as #8 oval-head wood screws 42 into the bores 41, the toilet seat supports 44, and in the toilet lid supports 46.

As best seen in FIG. 3, the pressure tee 24 is designed with a restrictive inlet passageway 48 which opens into a larger central passageway 50 that is seated with the ballcock fitting 20 and sealed by a commercially available O-ring 52 and the nut 28. In the industry, the nut 28 is referred to as a ⅞" female ballcock thread, but in actuality it is a 15/16×14 machine thread. When the tank valve (not shown) is open and water flows through the pressure tee 24, a reduced pressure situation occurs in passageway 50.

The pressure tee 24 is preferably composed of a plastic material, in this design high density polyethylene is used. This material is selected to allow the pressure tee 24 to be thermally formed with the rotatably retained nut 28 and to be compatible with the pressure tee 24, which is an acceptable and approved polyethylene plumbing tubing 5/16-OD with a 0.042 inch wall. The pressure tube 26 is secured to the pressure tee 24 by means of standard 5/16×18-NC threads and locked in place by a tapered ferrule 54 press-fitted to the inner diameter of the pressure tube 26. As thus far described, it can be seen that the check element 34 (which may be ball shaped, cylindrically shaped or otherwise shaped) will check against the ferrule 54 and act as an anti-siphon device if a vacuum is formed in passageway 50 of the pressure tee 24 for any reason.

Referring now to FIG. 4A, the opposing end of pressure tube 26 is similarly secured and locked in place by a ferrule 56 within an inlet fitting 58 off of a generally cylindrical first body portion 59' formed off of the left sanction 40'. The check element 34 will check against ferrule 56 when higher than normal water pressure fills the pressure tube 26 with water and this forces the check element 34 to seal against this ferrule 56 and prevent further pressurization of a sealed bladder cavity 60 which is more fully discussed below. Furthermore, if the bladder cavity 60 were to leak resulting in a reduced pressure in the cavity 60, the check element 34 will seal against ferrule 56 with any positive water pressure in the pressure tube 26 and prevent water from leaking into to the bladder cavity 60, and potentially externally, of the hinge 22.

A bladder 62, preferably constructed of an easily expandable material such as latex rubber, is sealingly fitted and secured within a bladder-stanchion 64, which is a portion of the first body 59', by a constricting inner diameter 66 of the bladder-stanchion 64 and a mating outer diameter and shoulders 67 formed in bladder 62 itself, or other method. The interior of the bladder 62 is in communication with the interior, air filled portion of the pressure tube 26 and as a result, an increase in water pressure in the pressure tube 26 will move the check element 34 toward the bladder 62, compressing the air filled portion and causing the bladder 62 to expand as shown in phantom 68 in FIG. 3. As a result, pressure increases within the bladder cavity 60.

The bladder cavity 60 is filled with a commercially available digestible white oil. One such material is a baby oil manufactured by the Johnson & Johnson Company. Oil is used to prevent freezing and subsequent damage to the hinge 22 if the hinge 22 inadvertently is exposed to freezing weather during shipping or any other frigid situation such as a home heating failure. The oil operates as a hydraulic fluid and transfers the increased pressure mentioned above through two or more ports 70 so as to expand two circumferential bladders 72' and 72". The bladders 72' and 72" extend circumferentially about the first body portion 59' (in outboard and inboard positions relative to the support stanchion 40' which is integrally or unitarily formed with the first body portion 59') and are received in circumferential recesses 73' and 73" formed therein. To securely hold the bladders 72' and 72" therein, bosses 75 on the bladders 72' and 72" are press-fit into grooves 77 in the recesses. When expanded, as designated in phantom at 71, the bladders 72' and 72", or friction pads 74' and 74" respectively mounted about the bladders 72' and 72", are respectively biased against the inner diameters of a cylindrical end cap 76 (which is integrally or unitarily formed with the seat support 44) and a cylindrical central body portion 78 (which is integrally or unitarily formed with the lid supports 46). The stationarily held first body portion 59' acts like a stator with respect to the rotatable end cap 76 and cylindrical portion 78 and, as such, frictional forces generated and by the expanded bladders 72' and 72" restrict movement of the end cap 76 and cylindrical portion 78. It can accordingly be seen that higher water pressure in the tube 26 will create greater frictional forces than lower water pressure.

By providing a small amount of air in the oil during assembly of the bladder cavity 60, the pressure at which the check element 34 checks against ferrule 56 can be adjusted as desired. A smaller amount of air causes a higher checking pressure than a larger amount of air.

FIG. 4B illustrates a dampening cavity 80 formed within the rotatable central body portion 78. A stationary extension 82, integrally or unitarily formed with the support stanchion 40 and the first body portion 59, extends into this cavity 80 and a viscous dampening fluid 84 fills the remainder of the cavity 80. The shape of the extension 82 (illustrated as triangular in cross-section) and the cavity 80 (semi-circular in cross-section) cause the fluid 84 to shift from one side of the extension 82 to the other through a restricted gap 86 as the toilet lid 12 is raised or lowered and the central body portion 78 rotated. As a result, the rotative motion of the lid 12 is controlled and rapid rotation of the lid 12 is restricted. A suitable commercially available dampening fluid 84 is a silicone viscous fluid, such as part number ST-920, SIL-TECH Corp., Tecumseh, Mich. Numerous other well known alternative materials could also be used. An O-ring 85 is utilized to retain the fluid 84 in the cavity 80.

Referring now to FIGS. 5–10B, seen therein is a lid torsion spring 88 which is assembled into an annular groove 90 and associated diametric groove 104 formed in the inboard end of the central body portion 78 and so as to extend transversely across the annular groove 90. The opposing end of the spring 88 is likewise positioned in an inboard annular groove 92 and associated, diametric groove 104 defined in the body 59" of the right side support stanchion 40". Assembled into a right end cap 94 (which is integrally or unitarily formed with the right seat support 44)

is a seat torsion spring 96. The outboard end of the torsion spring 96 is received within an annular groove 98 and diametric groove 104 defined in the end cap 94 while the spring's inboard end is received within an outboard annular groove 100 and diametric groove 104 defined in the body 59" of the right support stanchion 40". Each end of the springs 88 and 96 is formed with an inwardly directed tang 102. The tangs 102 are received in diametric grooves 104. In this manner, the springs 88 and 96 are prevented from freely rotating relative to the remainder of the hinge 22.

Figures 5, 6, 7, 8, 9, 10A, 10B:
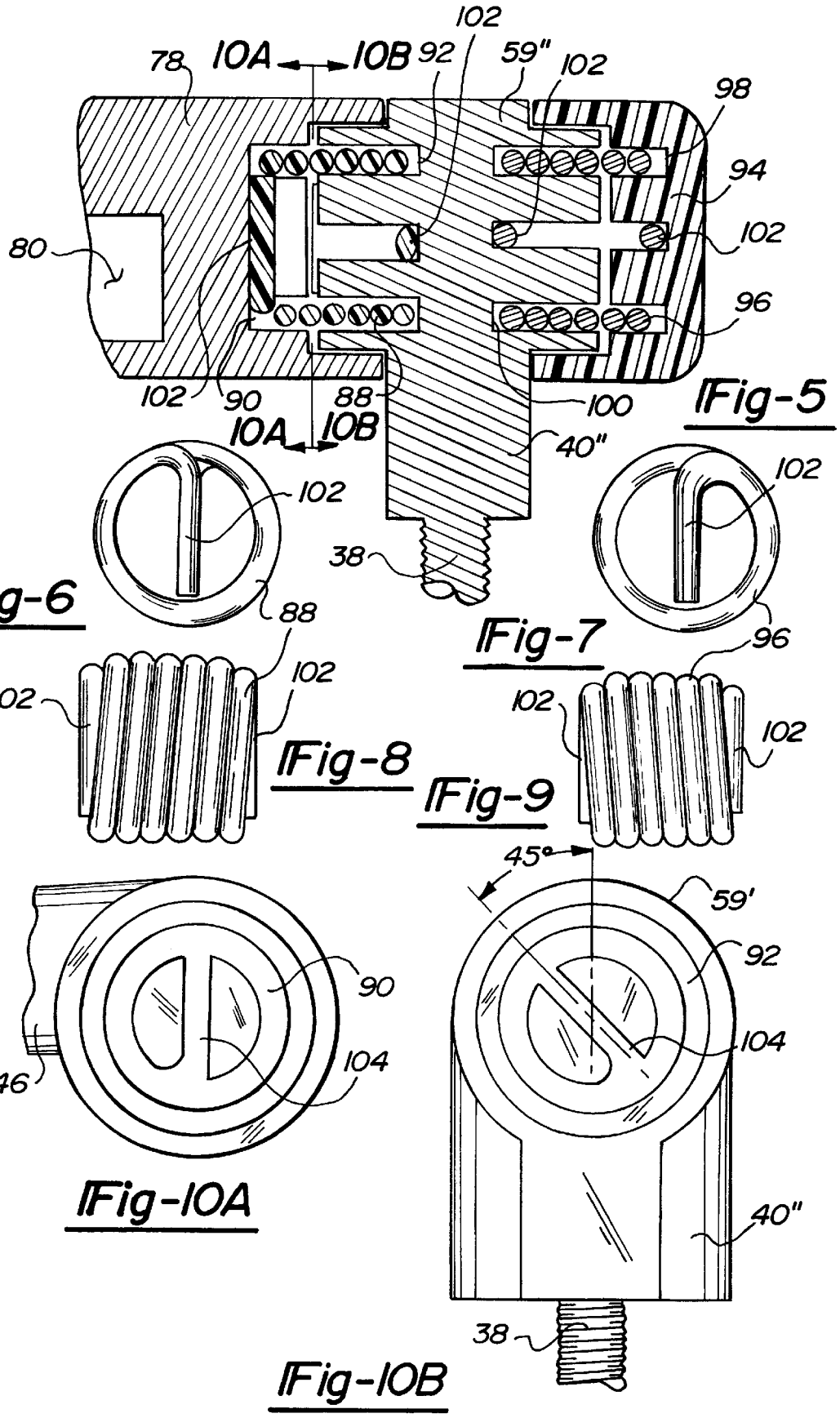
FIG. 5 is a cross-sectional view of the assembled torsion springs as provided by the present invention.
FIGS. 6–9 are side and end views of the torsion springs utilized in the present invention.
FIGS. 10A and 10B are side views of the toilet lid and mounting stanchion illustrating assembly of the torsion springs a preferred embodiment of this invention.

FIGS. 10A and 10B illustrate the annular grooves 90 and 92 and diametric grooves 104 apart from the spring 88. Preferably, the two diametric grooves 104 are associated with the lid 12 and lid spring 88 are offset from one another by 45 degrees and those associated with the seat 10 are offset by 60 degrees. The unbiased orientation of the tangs 102 is parallel for each spring 88 and 96.

Figure 11A:
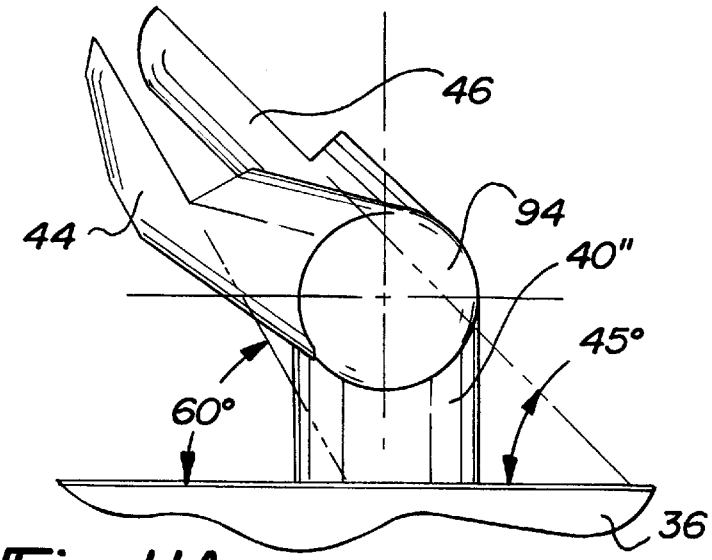
FIGS. 11A, 11B and 11C are side views illustrative of the positions and resulting actions the torsion springs utilized in the present invention have on a toilet seat and lid.
Figure 11B:
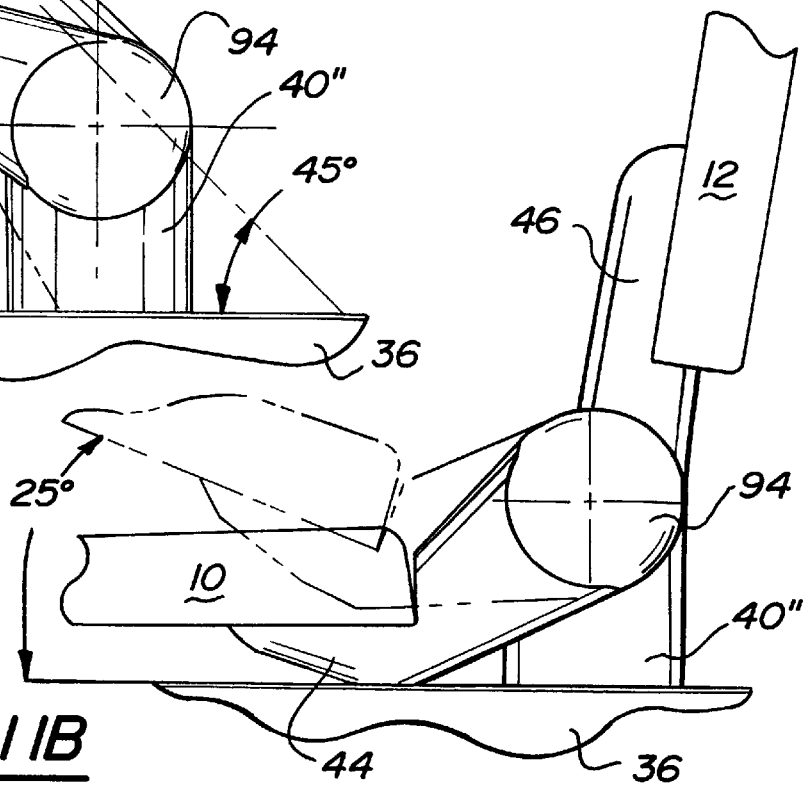

This angular positioning of the grooves 104 in the inboard end of the central body portion 78, the inboard side of the right stanchion 40", the outboard side of the right stanchion 40", and end cap 94 establish a pre-load which each torsion spring 88 and 96 respectively exerts on the lid supports 46 and the right seat support 44. As seen in FIG. 11A, the seat torsion spring 96 pre-loads the right end cap 94 and the right seat support 44 to hold the seat supports 44 at approximately 60 degrees. As a result of the pre-load along with the weight of the seat 10, the seat 10 is held or counterbalanced at approximately a 25 degree angle with respect to the rim 36 of the bowl 16. Accordingly, if freely descending from a vertical position the seat 10 will not strike the bowl 16 but will recover from its descending momentum and return to approximately 25 degrees, requiring a supplementary force to lower the seat 10 onto the bowl 16.

When the seat 10 is raised to the vertical position, the torsion spring 96 is back wound approximately 30 degrees resulting in a closing torque such that if released, the toilet seat 10 will begin closing as a result of the back spring force of the torsion spring 96 and will continue to close by its own weight until counterbalanced at 25 degrees.

Figure 11C:
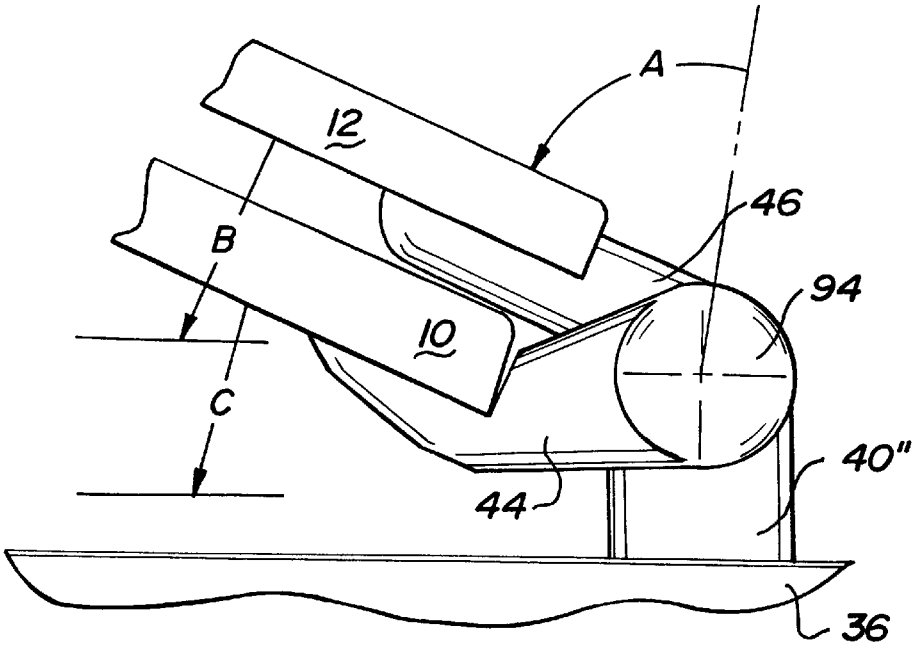

With the toilet lid 12 in an approximately vertical position, the lid torsion spring 88 is back wound approximately 45 degrees. This produces a substantial closing torque so that when the lid is released, it will close for 45 degrees before the lid torsion spring 88 begins to counterbalance its weight. The lid torsion spring 88 is designed to only partially counterbalance the lid's weight, allowing the unbalanced weight of the toilet lid 12 to force the counterbalanced toilet seat 10 to fully close down onto the rim 36 as shown in FIG. 11C, with the toilet lid 12 rotating solely through angle A and forcing the toilet seat 10 to close onto the rim 36 through angle C while the lid itself fully closes through angle B. The seat 10 and lid 12 are approximately 85 percent counterbalanced in the closed position, and the seat 10 will rise to 25 degrees if the lid 12 is lifted in that the seat 10 requires the weight of the lid 12 in order to remain closed.

The sequence of installing the hinge 22 of this invention to an existing operational toilet 15 entails mounting a lid 12 and seat 10 to the hinge 22 through the eight mounting bores 41 provided in the right and left seat supports 44 and the lid supports 46; attaching the hinge 22, with the assembled lid 12 and seat 10, to the bowl 16 using the mounting studs 38 and securing with appropriate nuts 39; turning off the water supply at the shut off valve (not shown) and clearing the tank 14 of water; removing the water supply fitting 32 at the ballcock thread 20; attaching the pressure tee 24 to ballcock thread 20 on the tank 14; tightening the nut 28 of the pressure tee 24 to the ballcock fitting 20; attaching the water supply fitting 32 to the threaded portion 30 of the pressure tee 24; and turning on the toilet water supple valve.

Upon opening of the water supply valve, the tank 14 will fill normally. When the tank is full, the water pressure in the pressure tee 24 will be at a maximum, usually around 40 pounds per square inch, and this pressure will force water into the pressure tube 26 pushing the check element 34 close to ferrule 56. The compressed air of the pressure tube 26 expands the bladder 62 forcing the friction pads 74' and 74" against the inner diameter of the left end cap 76 (which is coupled to the seat 10) and the inner diameter off the central body portion 78 (which is coupled to the lid 12) thereby creating a friction force which resists rotation. To open the toilet lid, a significant force is required to overcome this friction force and to displace the viscous dampening fluid 84. Preferably a force of about twice the weight of a toilet lid is required to override the friction force and dampening effects of the pads 74' and 74" and the dampening fluid 84. The additional effort to raise the lid 12, along with the lid 12 being normally biased closed after a previous use, is a deterrent to children and pets from exploring the contents of the toilet bowl 16.

With the friction force fully applied by full water pressure, the lid 12 can be manually opened or closed and will remain in any position when released. In raising the lid 12 to its substantially vertical position, the fully applied friction force prevents the lid torsion spring 88 from closing the lid 12. Additionally, the fully applied friction force does not allow the seat torsion spring 96 to raise the seat 10 back up to the counterbalanced 25 degree position when the lid 12 is raised. The toilet seat 10 therefore will remain down and in contact with the rim 36 of the bowl 16.

When the toilet 15 is flushed, the valve in the tank 14 opens to fill the tank 14. This reduces the pressure in the pressure tee 24 to approximately 10 pounds per square inch and this subsequently reduces the force exerted by the friction pads 74' and 74" as the bladders 62 contract due to the reduced pressure. When this happens, the seat torsion spring 96 raises the seat 10 to the counter balanced 25 degree position and the lid torsion spring 88 is permitted to bias the lid 12 to close. The viscous dampening fluid 84, however, slows and controls the lid's decent. After the descending lid 12 contacts the raised seat 10, both gradually return to the fully down position on the rim 36 thereby automatically closing the lid 12 when the toilet is flushed. When the tank 14 is again full, water pressure in the pressure tube 24 increases resulting in the expanding of the friction pads 74' and 74" to resist rotation of the lid 12 or seat 10.

When both the lid 12 and seat 10 are fully up or opened, the friction force exerted by the friction pads 74' and 74" is greater than the closing force of both the lid torsion spring 88 and the seat torsion spring 96. This holds the seat 10 and lid 12 in the open position. When the toilet 15 is flushed and the pressure in the pressure tee 24 is reduced as previously described, the friction pads 74' and 74" release both the seat 10 and lid 12. The seat 10 descends faster than the lid 12 since it's descent is not attenuated by the viscous dampening fluid 84. The seat 10 is then held at 25 degrees by the seat torsion spring 96 until the descending lid 12 gradually closes upon it to thereby automatically and fully close the lid 12 and seat 10 when the toilet 15 is flushed.

While the above description constitutes the preferred embodiment of the present invention, it will be appreciated that the invention is susceptible to modification, variation and change without departing from the proper scope and fair meaning of the accompanying claims.

I claim:

1. A hinge assembly for a toilet having a tank connected to a pressurized water supply, a bowl, a seat and a lid, said assembly comprising:

assembly mounting means for mounting said assembly to the bowl;

seat mounting means supported by said assembly mounting means for mounting the seat to said assembly and permitting rotation of the seat between open and closed positions;

lid mounting means supported by said assembly mounting means for mounting the lid to said assembly and permitting rotation of the lid between open and closed positions;

brake means for applying a braking force to hold the seat and the lid in said open position, said closed position, and positions intermediate therebetween;

biasing means for biasing the seat and the lid out of said open position and toward said closed position, said braking force being sufficient to prevent said biasing force from biasing the seat or lid out of said open position; and said brake means including coupling means for coupling said brake means to the pressurized water supply and causing a reduction in said braking force during flushing of the toilet and flow of water through the pressurized water supply thereby permitting said biasing means to move the seat or lid out of said open position and toward said closed position.

2. A hinge assembly according to claim 1 further comprising dampening means for controlling rotative motion of the lid from said open position into said closed position.

3. A hinge assembly according to claim 1 wherein said brake means applies said braking force to said seat mounting means.

4. A hinge assembly according to claim 3 wherein said seat mounting means includes a housing being rotatable during rotation of said seat, said brake means applying said braking force to said housing.

5. A hinge assembly according to claim 4 wherein said braking means applies said braking force to an interior surface of said housing.

6. A hinge assembly according to claim 5 wherein said braking means includes an inflatable friction bladder, said friction bladder engaging said interior surface when inflated.

7. A hinge assembly according to claim 6 wherein said friction bladder is inflatable by hydraulic pressure exerted by said hydraulic fluid.

8. A hinge assembly according to claim 7 wherein said hydraulic fluid is retained within a cavity of said lid mounting means.

9. A hinge assembly according to claim 7 wherein said friction bladder extends circumferentially.

10. A hinge assembly according to claim 7 wherein said coupling means includes an inflatable pressure bladder, said pressure bladder deflating when reduced pressure exists in said water supply line.

11. A hinge assembly according to claim 10 wherein said pressure bladder is in contact with said hydraulic fluid and causes increased hydraulic pressure and an increased braking force when said pressure bladder is inflated.

12. A hinge assembly according to claim 1 wherein said coupling means and coverts water pressure in the supply line into said braking force.

13. A hinge assembly according to claim 1 wherein said coupling means includes an inflatable pressure bladder, said pressure bladder deflating when reduced pressure exists in said water supply line.

14. A hinge assembly according to claim 1 wherein said seat biasing means includes a torsion spring and said lid biasing means includes a torsion spring.

15. A hinge assembly according to claim 1 wherein said seat biasing means biases said seat mounting means to a position between said open and closed positions.

16. A hinge assembly according to claim 1 wherein said braking force is greater than said biasing force when the water is not flowing through said water supply.

17. A hinge assembly according to claim 2 wherein said dampening means includes portions defining a cavity, a viscous fluid in said cavity, and an extension of said assembly mounting means extending into said cavity and dividing said cavity into first and second portions with a restricted opening therebetween, said extension and said cavity being moveable relative one another such that said viscous fluid moves between said first and second portions through said restricted opening.

18. A hinge assembly according to claim 17 wherein said cavity is defined by said lid mounting means.

19. A hinge assembly according to claim 1 wherein said seat and lid mounting means are supported about said assembly mounting means and rotatable relative thereto.

20. A hinge assembly according to claim 1 wherein said brake means is supported on said assembly mounting means.

* * * * *